United States Patent [19]

Bryan

[11] Patent Number: 4,696,231

[45] Date of Patent: Sep. 29, 1987

[54] SHOCK-RESISTANT DELAY DETONATOR

[75] Inventor: Paul J. Bryan, Hewitt, N.J.

[73] Assignee: E. I. Du Pont de Nemours and Company, Wilmington, Del.

[21] Appl. No.: 832,777

[22] Filed: Feb. 25, 1986

[51] Int. Cl.[4] ..... F42B 3/10; F42C 19/08

[52] U.S. Cl. ..... 102/202.5; 102/204

[58] Field of Search ..... 102/202.5, 202.13, 202.14, 102/204

[56] References Cited

U.S. PATENT DOCUMENTS

| | | | |
|---|---|---|---|
| 2,123,691 | 7/1938 | Burrows et al. | 102/202.13 |
| 2,560,452 | 7/1951 | Kerr et al. | 102/202.13 |
| 2,717,204 | 9/1955 | Noddin et al. | 102/202.13 |
| 2,761,386 | 9/1956 | Zebree | 102/202.13 |
| 2,823,609 | 2/1958 | Johnson et al. | 102/275.3 |
| 2,878,752 | 3/1959 | Johnson et al. | 102/202.13 |
| 2,908,559 | 10/1959 | Zebree | 102/202.13 |
| 2,999,460 | 9/1961 | Stinger et al. | 102/202.13 |
| 3,182,592 | 5/1965 | Barocca | 102/312 |
| 3,306,201 | 2/1967 | Noddin | 102/275.3 |
| 3,358,601 | 12/1967 | Dittmann et al. | 102/202.6 |
| 3,476,623 | 11/1969 | Menke et al. | 149/35 |
| 3,499,386 | 3/1970 | Stadler et al. | 102/202.8 |
| 3,631,802 | 1/1972 | Lawrence | 102/202.11 |
| 4,073,235 | 2/1978 | Hopler, Jr. | 102/200 |
| 4,215,631 | 8/1980 | Rucker | 102/275.5 |
| 4,369,708 | 1/1983 | Bryan et al. | 102/202.13 |
| 4,429,632 | 2/1984 | Yunan | 102/202.5 |
| 4,484,960 | 11/1984 | Rucker | 102/202.5 |

*Primary Examiner*—Charles T. Jordan

*Attorney, Agent, or Firm*—Hilmar L. Fricke

[57] ABSTRACT

Delay detonators can be made to function reliably at reduced distances from a neighboring detonation by increasing the weight of the detonator's priming charge. Detonators containing about 0.26 g or more of lead azide perform reliably 12.7 cm from a detonation in a shock resistance pipe test, and this performance is reflected in high performance in trenching operations. The higher energy output of the heavier primer charge may compensate for a decrease in the base charge's sensitivity as the detonator shell is deformed or collapsed by shock.

9 Claims, 3 Drawing Figures

SHOCK-RESISTANT DELAY DETONATOR

BACKGROUND OF THE INVENTION

1. Field of the Invention

The present invention relates to delay detonators, and more particularly to delay detonators having improved resistance to external shock.

2. Description of the Prior Art

The explosive charges used in trenching operations often are loaded into holes which are close enough to one another that the shock from the detonation of an earlier-fired charge may deleteriously affect a delay detonator positioned in the charge in an adjacent hole to be fired thereafter, with the result that the latter charge may fail to detonate, or detonate incompletely. Such failures are even more prevalent when the shooting is carried out in wet areas, where shock transmission is enhanced. In many cases, detonators which have failed to function properly owing to explosive shock effects in wet areas, sometimes referred to in the art as the "water hammer" effect, appear to have been crushed, suggesting that reinforcement of the shell wall might alleviate the problem. Such reinforcement would be costly, however, and could reduce the detonator's output.

SUMMARY OF THE INVENTION

The present invention provides an improvement in delay detonators comprising a tubular metal shell integrally closed at one end and containing, in sequence from the closed end, (a) a base charge of a detonating explosive composition, (b) a priming charge of heat-sensitive detonating explosive composition, (c) a delay charge of an exothermic-burning composition, and (d) an ignition assembly for igniting said delay charge. The improvement provided by the invention comprises, in said detonator, a priming charge, preferably of lead azide, of above-standard weight and output level of a magnitude which adapts the detonator, without reinforcement of said shell around said base and priming charges, to give consistent, full-output detonation upon being actuated in a water-filled steel pipe after the simultaneous detonation therein of a side-by-side pair of detonators, separated therefrom, base charge from base charge, by a distance of 12.7 cm.

The detonator may be ignited electrically or non-electrically, and the delay charge may be loaded directly into the detonator shell over the priming charge, or housed within a thin capsule or heavy-walled carrier tube, which is seated in the detonator shell over the priming charge.

The expression "above-standard in weight and output level" as used herein to describe the priming charge in the detonator of the invention denotes that the priming charge weight is higher, and generally at least about 50 percent higher, than the priming charge loads traditionally used in standard commercial delay detonators of otherwise the same structure and compositional make-up, and higher than the priming charge loads in non-commercial detonators of essentially the same type which are known to the art. It is important that the basis for selecting a priming charge weight which is "above-standard" be a standard detonator of the same structure and compositional make-up because one detonator's standard primer load may be an above-standard, or even a below-standard, load for another.

"Standard" primer loads are different depending on such factors as the chemical composition of the priming charge, the detonator's internal pressure, etc. Thus, with more energetic compositions, such as lead azide, standard primer loads have been smaller than in the case of less energetic compositions, such as diazodinitrophenol/potassium chlorate mixtures. Also, standard primer loads have been larger in detonators that develop high internal pressures, e.g., those which employ delay charges long enough to provide nominal delay times on the order of about 7400 milliseconds or more. Consequently "above-standard" primer loads, as the term is used herein, will cover a range which, at its lower end, will be "above-standard" for the detonators containing the more energetic priming compositions, i.e., about 0.26 gram or more, but "standard" for detonators containing the less energetic priming compositions and those which employ long delay charges. Higher levels within the "above-standard" range, e.g., 0.3–0.4 gram or more, are "above-standard" regardless of priming charge composition and delay length (i.e., internal pressure).

Thus, for detonators containing the preferred priming charge composition, i.e., lead azide and materials of comparable energy, the above-standard weight will be at least about 0.26 gram, while for those containing less-energetic priming charge compositions, the above-standard weight will be above 0.3, and usually at least 0.4, gram. For long-delay detonators, i.e., those having a nominal delay time of 7400 milliseconds or more, the above-standard weight is at least about 0.32 gram. Regardless of the detonator structure and compositional make-up, however, the priming charge's above-standard weight adapts the detonator, without reinforcement of its shell around the base and priming charges, to perform as specified in the pipe test which has been referred to above and will be described in greater detail hereinafter.

BRIEF DESCRIPTION OF THE DRAWING

In the accompanying drawing.

DETAILED DESCRIPTION

Figure 1:
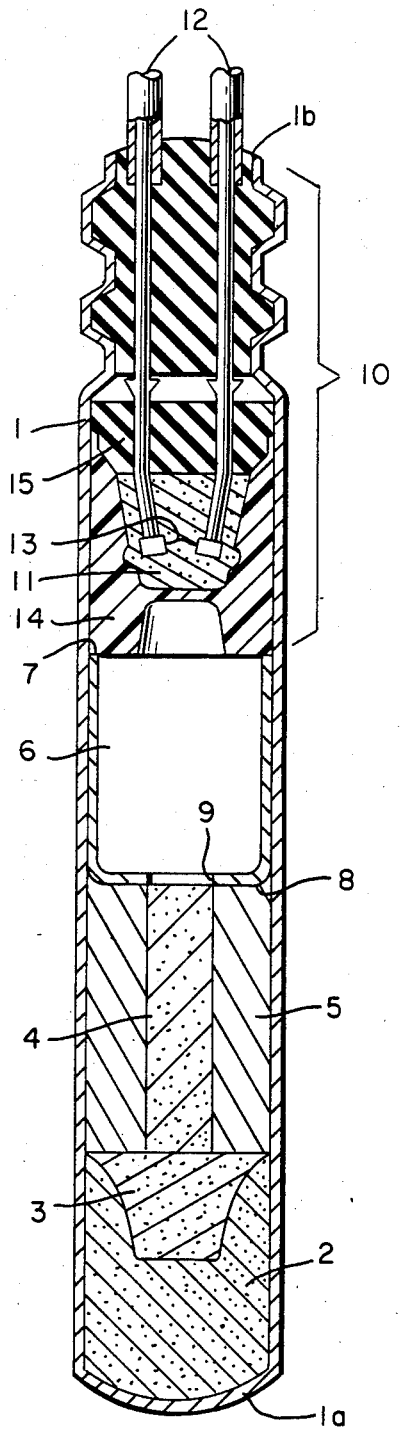
FIG. 1 is a longitudinal cross-section of an electrical delay detonator of the invention wherein the delay charge is held in a heavy-walled carrier tube.

The present invention is based on the discovery that the shock resistance of a delay detonator can be improved, and, more particularly, its ability to function normally in closely placed holes in wet areas can be enhanced, by increasing the weight of its priming charge, i.e., by using a weight of priming charge which is above-standard in level. While an "above-standard weight" can differ depending on the specific detonator under consideration, and the weight of priming charge needed to improve the detonator's shock resistance can vary depending on several factors, boosting the weight of the priming charge, e.g., by about 50 percent or more, in any given detonator will effect the improvement.

The improvement in a detonator's shock resistance achieved by increasing the weight of the priming charge therein is unexpected, and the mechanism by which the improvement occurs is not clearly understood. However, while I do not intend for my invention to be limited by theoretical considerations, it is believed that the higher energy output of the heavier priming charge, or more precisely, the higher detonation pressure achieved with the heavier priming charge, may compensate for a decrease in the sensitivity of the base charge that could result as a consequence of its densification as the detonator shell is deformed or collapsed by shock. Thus, despite the fact that the detonator shell is unreinforced at the base charge end and may buckle, the base charge will detonate, and the detonator function as designed, owing to the priming charge's increased output.

The priming charge composition used in the detonator of this invention can be any of the heat-sensitive detonating explosive compositions known to the art for use as priming charges in detonators. Lead azide is the most commonly used compound and is preferred. Other compounds which can be used include nitromannite, mercury fulminate, and diazodinitrophenol. Mixtures such as diazodinitrophenol/potassium chlorate, nitromannite/diazodinitrophenol, and lead azide/lead styphnate also can be employed.

When lead azide, or a composition of comparable strength (such as nitromannite), is employed as the priming charge in the present detonator, the charge weight is at least 0.26 gram, and preferably is about 0.32 gram or more, when the detonator's delay charge is held in a heavy-walled carrier tube and is of a length as to provide a delay time in the range of 25 to 6500 milliseconds. If the delay charge is loaded directly into the detonator shell atop the priming charge, delay detonators in this delay range should contain at least about 0.32 gram; and preferably about 0.39 gram or more, of the lead azide priming charge. Traditionally, standard commercial delay detonators containing lead azide as the priming composition have employed about from 0.12 to 0.17 gram of lead azide. Thus, the above-standard lead azide primer load used in the present detonator is at least 53 percent higher than standard loads, and may be more than twice such loads. As the size of the lead azide charge is increased, the minimum distance for reliable detonator function is reduced to below 12.7 cm. Therefore, larger lead azide loads, e.g., up to about 0.65 gram, are desirable when an extra measure of reliability is required in terms of detonation pressure available to initiate a highly densified base charge. Also, higher lead azide loads are required in detonators having long delay charges, e.g., those providing 7400 milliseconds or more, owing to the high internal pressure produced therein. In these detonators, the above-standard priming charge level required for consistent, full-output detonation in the above-mentioned pipe test is higher, and generally at least about 50 percent higher, than 0.29 gram, the level traditionally employed therein.

When less energetic compositions are employed as the priming charge, the charge weight preferably should be at least 0.44 gram, which is 50 percent higher than standard loads for diazodinitrophenol, for example. Diazodinitrophenol/potassium chlorate mixtures (75/25) preferably should be used at levels of about 0.52 gram and higher to enable the detonator to meet the requirements of the pipe test.

The weights of priming charges given above for various priming charge compositions and delay lengths are high enough to adapt the detonators which contain them to perform as specified in the pipe test to be described below. Moreover, for any given priming charge composition in a detonator of a given design, whether or not a selected priming charge weight meets the above-standard requirement of this invention can be determined by the detonator's performance in this test:

The test is performed in a water-filled steel pipe having a 5-cm inner diameter. The test detonator is fixed in position in the pipe essentially parallel to the pipe's longitudinal axis and with its base charge end separated by a distance of 12.7 cm from the base charge ends of a longitudinally arrayed side-by-side pair of 25-millisecond electric delay detonators, each having a 0.51 gram pentaerythritol tetranitrate (PETN) base charge and a 0.17-gram lead azide priming charge. The pair of detonators are caused to fire simultaneously, and the test detonator thereafter. This may be accomplished, when the test detonator is an electrically actuated delay detonator having a 50-millisecond or more delay time, by applying current to all three detonators at the same time whereby the pair of detonators detonate 25 milliseconds thereafter, and the test detonator 25 or more milliseconds after that. Test detonators whose priming charge weight and output are at above-standard levels detonate consistently and fully in this test.

In FIG. 1, 1 is a tubular metal shell having one integrally closed end 1*a;* 2 is a base charge of a pressed detonating explosive composition, e.g., PETN, cyclotrimethylenetrinitramine, cyclotetramethylenetetranitramine, lead azide, picryl sulfone, nitromannite, TNT, and the like; 3 is a priming charge of a pressed heat-sensitive detonating explosive composition, e.g., lead azide, mercury fulminate, diazodinitrophenol, or a similar composition; 4 is a delay charge of a pressed exothermic-burning composition; and 5 is a heavy-walled rigid carrier tube for delay charge 4.

Tubular metal capsule 6 is nested within shell 1 in snug fit therein, capsule 6 having one open extremity 7, and a closed extremity 8 provided with an axial orifice 9. Capsule 6 is seated within shell 1 with closed extremity 8 resting adjacent to delay carrier tube 5 so that delay charge 4 is exposed at orifice 9. Open extremity 7 faces ignition assembly 10, which consists of heat-sensitive ignition composition 11, a pair of leg wires 12, and high-resistance bridge wire 13. Ignition composition 11 is seated within plastic ignition cup 14. Grooved rubber plug 15 is securely crimped in the open end 1*b* of shell 1 over ignition composition 11, forming a water-resistant closure and firmly positioning the ends of leg wires 12 inside shell 1.

Figure 2:
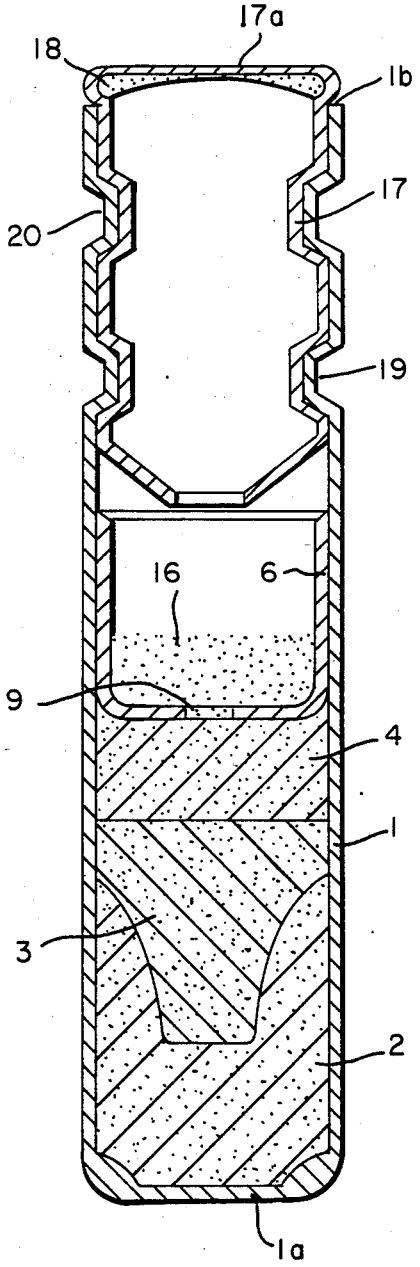
FIG. 2 is a longitudinal cross-section of a non-electric delay detonator of the invention wherein the delay charge is loaded directly in the detonator shell.
Figure 3:
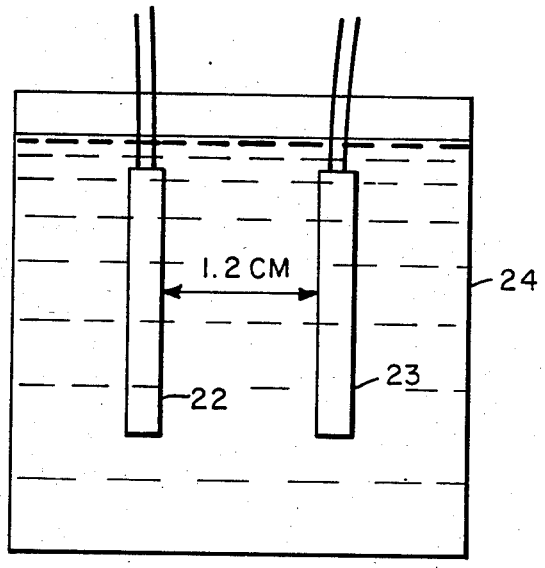
FIG. 3 shows two detonators 22 and 23 positioned in a water-filled pipe.

The non-electric detonator shown in FIG. 2, delay charge 4 is pressed directly into shell 1 over priming charge 3. A flame-sensitive ignition charge 16 is loosly loaded into metal capsule 6. The closure of capsule 6 which contains orifice 9 is seated against delay charge 4.

The open end 1*b* of shell 1 is closed by an ignition assembly comprising primer shell 17, in this case a rim-fired empty primed rifle cartridge casing. Shell 17 has an open end and an integrally closed end 17*a* which peripherally supports on its inner surface a percussion-sensitive primer charge 18 for rim firing, e.g., by the percussive force applied to it by the detonation of an adjacent length of low-energy detonating cord. Shell 17 extends open end first into shell 1 to dispose end 17*a* adjacent, and across, the end of shell 1. Circumferential crimps 19 and 20 secure shell 17 in the end of shell 1, while forming a water-resistant closure for shell 1.

In the detonators shown in FIGS. 1 and 2, priming charge 3 has a tapered geometry with its outer surface surrounded by base charge 2. In an alternative, less preferred, embodiment, charge 3 is essentially cylindrical and is seated on top of charge 2, e.g., with its outer surface in contact with shell 1.

The delay charge in the present detonator can be any of the essentially gasless exothermic-reacting mixtures of solid-oxidizing and reducing agents that burn at constant rate and that are commonly used in ventless delay detonators. Examples of such mixtures are boron-red lead, boron-red lead-silicon, boron-red lead-dibasic lead phosphite, aluminum cupric oxide, magnesium-barium peroxide-selenium, and silicon-red lead.

EXAMPLES 1-7

The following detonators of the invention were made and tested:

Detonator A—This was the detonator shown in FIG. 1. Shell 1, made of Type 5052 aluminum alloy, was 80 mm long, and had an internal diameter of 6.6 mm and a wall thickness of 0.36 mm. Delay carrier 5, made of zinc, was 28 mm long, and had an internal diameter of 3.4 mm and a wall thickness of 1.5 mm. Capsule 6, made of bronze, was 11 mm long, and had an outer diameter of 6.5 mm and a wall thickness of 0.5 mm. Axial orifice 9 was 3 mm in diameter. Base charge 2 consisted of 0.51 gram of PETN, which had been placed in shell 1 and pressed therein at 1330 Newtons with a pointed press pin. Priming charge 3 was dextrinated with lead azide. Delay charge 4, which was pressed into carrier tube 5 at 350 Newtons, was 0.9 gram of a mixture of silicon and red lead, the silicon content of the mixture being chosen to provide a delay time of 475 milliseconds. Priming charge 3 was loosely loaded into shell 1 and pressed as carrier tube 5, containing charge 4, was seated above it in shell 1 with a force of 1330 Newtons. Components of ignition assembly 10 were plastic, e.g., polyethylene, ignition cup 14, heat-sensitive ignition charge 11, in this case 0.27 gram of a 2/98 boron/red lead mixture, grained with polysulfide rubber, and plastic-insulated copper leg wires 12 having bared ends connected to 0.0396-mm-diameter, 1.00-ohm resistance bridge wire 13 embedded in the ignition charge. Ignition cup 14 was seated onto capsule 6.

Detonator B—This was the same as Detonator A with the exception that delay carrier 5 was omitted, and delay charge 4 was loaded directly into shell 1 as is shown in FIG. 2. Charge 4 was loosely loaded into shell 1 over priming charge 3, and capsule 6 was seated into shell 1 over charge 4 at 1330 Newtons. The delay period was 100 milliseconds.

Detonators A and B having different weights of the described priming composition were subjected to the above-described pipe test to evaluate their resistance to shock and consequently their ability to perform reliably in trenching operations.

The detonator being tested was fixed in position with its base charge end facing the base charge ends of the side-by-side pair of 25 ms detonators with different spacings, D, between the facing detonators. The pair of detonators and the detonator being tested were all actuated at once, with the pair of detonators detonating 25 ms thereafter, and the detonator being tested detonating thereafter. The minimum D at which a given detonator functioned reliably and produced full output was determined by varying D. The results are shown in the following table:

| Example No. | Detonator Type | Priming Charge Wt. (g) | Minimum D* (cm) |
|---|---|---|---|
| 1 | A | 0.65 | 7.6 |
| 2 | B | 0.65 | 5.1 |
| 3 | A | 0.52 | 7.6 |
| 4 | B | 0.52 | 7.6 |
| 5 | A | 0.39 | 12.7 |
| 6 | B | 0.39 | 10.2 |
| 7 | A | 0.26 | 12.7 |
| Control Expt. 1 | B | 0.26 | 20.3 |
| Control Expt. 2 | A | 0.13 | 25.4 |

*For consistent, full-output detonation.

The same test was employed to determine the distances at which unacceptable performance has been observed with standard commercial detonators. The Type A detonator was used in all cases. The results were as follows:

| Priming Charge | D (cm) | Type of Failure |
|---|---|---|
| 0.17 g dextrinated lead azide | 15.2 | Partial detonation |
| 0.27 g 75/25 diazodinitrophenol/potassium chlorate | 27.9+ | Partial detonation |
| 0.18 g nitromannite/diazodinitrophenol | 25.4+ | Partial detonation and failure |

Field observations have shown that all detonators which give a minimum distance of 12.7 cm for full consistent detonation in the above test (the Example 1-7 detonators, all containing 0.26 gram or more of priming charge) are high-performance detonators for trenching operations. As can be seen, the currently available commercial products did not give acceptable results in this test even at much larger distances. However, Examples 1 through 7 all describe detonators which meet the 12.7 cm minimum distance requirement. The key to success in all of these exemplified detonators was their higher priming charge weight. Increasing the size of the priming charge in Detonators A and B dramatically reduced the distance that could be tolerated between the shock-producing pair of detonators and the detonator being tested, i.e., the minimum distance over which the detonator functions reliably at full output. This beneficial effect was achieved regardless of whether or not a delay carrier tube was present, although in the detonator having no delay carrier (Detonator B) more priming charge(i.e., more than 0.26 g) was needed to achieve a minimum distance of at least 12.7 cm.

As has been shown, the present invention provides a way of achieving shock resistance in a detonator without the need of reinforcing the shell wall around the priming charge, the base charge, or both, and the pipe test employed to determine the above-standard primer load and output levels is performed without such reinforcement. However, while in the preferred detonator no reinforcement is present (e.g., a metal capsule or tube around the priming charge, the base charge, or both), such reinforcement can be used together with the heavier primer load in the detonator of the invention, especially if desired for some other purpose.

I claim:

1. In a delay detonator comprising a tubular metal shell integrally closed at one end and containing, in sequence from the closed end, (a) a base charge of a detonating explosive composition, of pentaerythritol tetranitrate (b) a priming charge of a heat-sensitive detonating explosive composition, (c) a delay charge of an exothermic-burning composition, and (d) an ignition assembly for igniting said delay charge, the improvement comprising a priming charge of lead azide above-standard weight weighing at least 0.26 grams and output level of a magnitude which adapts the detonator, without reinforcement of said shell around said base and priming charges, to give consistent full-output detonation upon being actuated in a water-filled steel pipe after the simultaneous detonation therein of a side-by-side pair of detonators separated therefrom, base charge from base charge, by a distance of 12.7 cm.

2. A detonator of claim 1 wherein said priming charge is tapered and embedded in said base charge.

3. A detonator of claim 1 wherein said priming charge is in contact with the inner wall of said shell.

4. A detonator of claim 1 wherein said delay charge provides a delay of up to about 6500 milliseconds.

5. A detonator of claim 4 wherein said delay charge is housed in a heavy-walled carrier tube.

6. A detonator of claim 4 wherein said delay charge is loaded directly in said tubular metal detonator shell.

7. A detonator of claim 6 wherein said priming charge weighs at least about 0.32 gram.

8. A detonator of claim 1 wherein said ignition assembly contains an ignition charge ignitible by the delivery of electrical energy thereto.

9. A detonator of claim 1 wherein said ignition assembly contains an ignition charge ignitible by a pressure pulse applied by the detonation of a detonating cord.

* * * * *